US009429916B2

(12) United States Patent
Born et al.

(10) Patent No.: US 9,429,916 B2
(45) Date of Patent: Aug. 30, 2016

(54) ISOCHRONOUS PARAXIAL TIMEPIECE RESONATOR

(71) Applicant: ETA SA Manufacture Horlogere Suisse, Grenchen (CH)

(72) Inventors: Jean-Jacques Born, Morges (CH); Jean-Luc Helfer, Le Landeron (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/863,513

(22) Filed: Sep. 24, 2015

(65) Prior Publication Data

US 2016/0091862 A1 Mar. 31, 2016

(30) Foreign Application Priority Data

Sep. 26, 2014 (EP) ..... 14186657

(51) Int. Cl.
*G04B 17/04* (2006.01)

(52) U.S. Cl.
CPC ..... *G04B 17/04* (2013.01); *G04B 17/045* (2013.01)

(58) Field of Classification Search
CPC ..... G04D 7/082; G04D 7/1214; G04D 7/10; G04B 17/04; G04B 17/045
See application file for complete search history.

(56) References Cited

U.S. PATENT DOCUMENTS

| | | | | |
|---|---|---|---|---|
| 1,951,995 | A * | 3/1934 | Schaad | G04B 17/063 368/169 |
| 3,269,106 | A | 8/1966 | Waldburger | |
| 3,316,708 | A | 5/1967 | Waldburger | |
| 3,318,087 | A * | 5/1967 | Favre | G04B 17/04 310/36 |
| 7,950,846 | B2 * | 5/2011 | Hessler | G04B 17/20 368/127 |
| 8,002,460 | B2 * | 8/2011 | Daout | G04B 17/066 368/175 |
| 8,672,535 | B2 * | 3/2014 | Boulenguiez | G04B 17/066 368/169 |
| 9,201,398 | B2 * | 12/2015 | Cusin | G04B 13/025 |
| 2013/0176829 | A1 * | 7/2013 | Cusin | G04B 13/025 368/127 |
| 2015/0063082 | A1 * | 3/2015 | Stranczl | G04B 15/00 368/127 |

FOREIGN PATENT DOCUMENTS

| | | |
|---|---|---|
| CH | 481 411 | 12/1969 |
| CH | 509 617 | 3/1971 |
| CH | 509 618 | 3/1971 |
| FR | 1 421 123 | 12/1965 |
| FR | 1 442 041 | 6/1966 |

OTHER PUBLICATIONS

European Search Report issued Aug. 10, 2015 in European Application 14186657, filed on Sep. 26, 2014 ( with English Translation).

* cited by examiner

*Primary Examiner* — Sean Kayes
(74) *Attorney, Agent, or Firm* — Oblon, McClelland, Maier & Neustadt, L.L.P

(57) ABSTRACT

A timepiece resonator including one weight connected by flexible strips to fixed attachment points of a fixed structure, this weight being subjected to a torque and/or a stress, and oscillating with at least two degrees of freedom in translation, and these flexible strips maintain the oscillations of this weight about a virtual pivot.

24 Claims, 3 Drawing Sheets

ISOCHRONOUS PARAXIAL TIMEPIECE RESONATOR

This application claims priority from European Patent Application No. 14186657.4 filed on Sep. 26, 2014, the entire disclosure of which is hereby incorporated herein by reference.

FIELD OF THE INVENTION

The invention concerns an equipped timepiece resonator for a watch movement, including one weight connected by a plurality of flexible strips to points of attachment of a fixed structure, formed by a plate of said movement or arranged to be secured to such a plate, said weight being arranged to be subjected to a torque and/or a stress.

The invention also concerns a timepiece movement including a plate that supports, directly or indirectly by means of a fixed structure, at least one such resonator.

The invention also concerns a watch including a movement of this type.

The invention concerns the field of timepiece oscillators, and more specifically oscillators with flexible guiding about virtual pivots.

BACKGROUND OF THE INVENTION

There are known flexible guide members, especially for the precise positioning of components. These guide members are known to have a nonlinear restoring force, with a nonlinearity defect on the order of one percent, which is equivalent to several hundreds of seconds per day. Although this design has great advantages, it therefore has the drawback of not being isochronous.

CH Patent Nos 509617 and 509618 in the name of OMEGA Louis Brant & Frères disclose a resonator with a plurality of long sinuous elastic strips, with two parallel pierced plates, connected, at two diametrically opposite points on their periphery, to each other and to a frame, each plate being formed by several rings, or several zigzag arms, each connecting one of these connecting points to a central weight. These plates vibrate in phase opposition perpendicularly to their planes, and each has a generally circular shape. Depending on the case, each plate is formed of a series of concentric rings connected by attachment members offset by 90°, or each zigzag arm is formed of a series of elements in concentric arcs of a circle.

CH Patent No 481411 in the name of MOVADO describes a resonator with long flexible loop-shaped strips connecting a network of weights.

FR Patent Nos 1442041 and 1421123 in the name of Centre Electronique Horloger also describe systems similar to the above system.

SUMMARY OF THE INVENTION

It is an object of the invention to propose a resonator, notably a paraxial resonator, having one weight that is movable in two linear and orthogonal degrees of freedom, which is naturally more isochronous than the aforementioned resonators with flexible guide members.

To this end, the invention concerns an equipped timepiece resonator according to claim 1.

The invention also concerns a timepiece movement including a plate that supports, directly or indirectly by means of a fixed structure, at least one such resonator.

The invention also concerns a watch including a movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
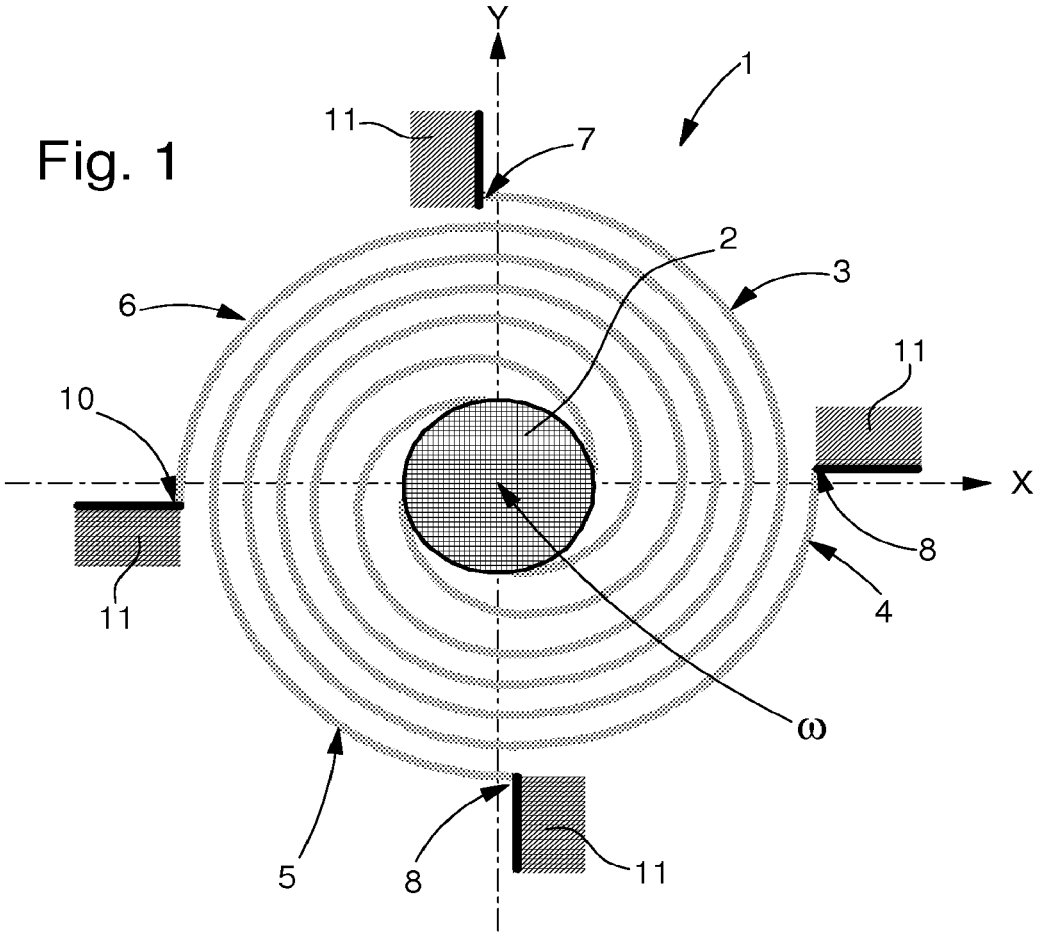
FIG. 1 shows a schematic partial plan view of a fixed structure of a watch movement carrying a paraxial plane resonator according to the invention, including a weight suspended by four flexible strips forming long spiral arms, about a virtual pivot.
Figure 2:
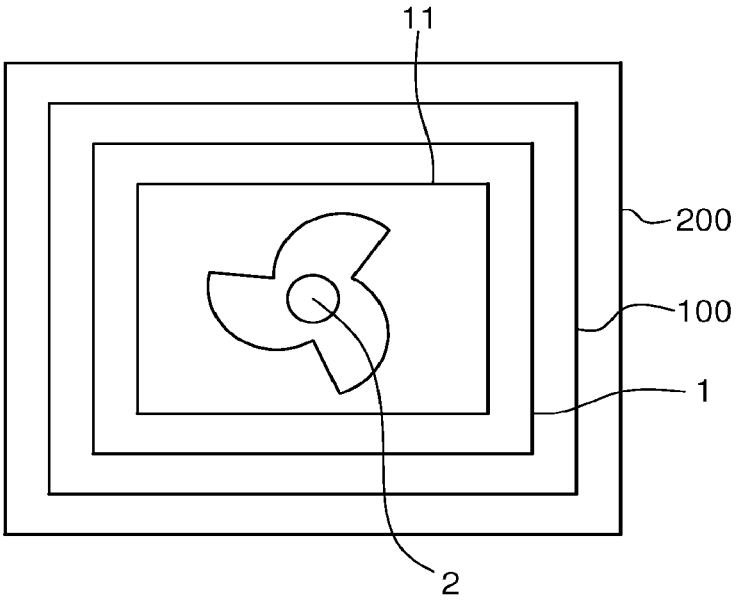
FIG. 2 shows a block diagram of a watch including a movement incorporating one such paraxial plane resonator.

The invention utilises, as flexible guide members, very long spiral arms, to prevent movements on a first axis X perturbing the restoring force on a second axis Y, orthogonal to first axis X, and vice versa.

To avoid angular stiffness that is too low, which is likely to cause parasitic rotations of the resonator weight or weights, the weight is concentrated as close as possible to the centre, to reduce inertia, and thus increase the natural frequency of rotation, which prevents any detrimental excitation.

Different variants, similar to various known balance spring embodiments, can improve the isochronism of such a resonator.

It is thus possible to vary, in a non-limiting manner:

- the number of turns of the spiral, including the fractional number of turns;
- the spiral pitch, which may be non-constant, and vary along the spiral;
- the thickness of the spiral, which may vary along the spiral, to make the resonator as isochronous as possible (perfectly quadratic potential energy on x and y, and thus proportional to $x^2+y^2$);
- the number of spiral-shaped arms.

The Figures illustrate non-limiting example embodiments of the invention.

The invention concerns an equipped timepiece resonator 1, for a watch movement 100, including at least one weight 2 connected, by a plurality of flexible strips 3, 4, 5, 6, to points of attachment 7, 8, 9, 10 of a fixed structure 11, formed by a plate of a movement 100 or arranged to be secured to such a plate, said at least one weight 2 being arranged to be subjected to a torque and/or a stress, said resonator 1 being of the paraxial type here, i.e. the weight 2 is arranged to oscillate with at least two degrees of freedom in translation.

Preferably, this at least one weight 2 is only one weight 2.

Preferably, flexible strips 3, 4, 5, 6 are arranged to maintain the oscillations of said at least one weight 2 about a virtual pivot ω.

In a particular variant, these flexible strips 3, 4, 5, 6 include long arms, each having a length at least two times greater than the shortest distance between weight 2 and attachment points 7, 8, 9, 10.

According to the invention, each at least one weight 2 is arranged to oscillate with at least two degrees of freedom in translation.

More specifically, these long arms are all coplanar, and their developed length is greater than the circumference of weight 2 in the plane occupied by the arms.

Figure 3:
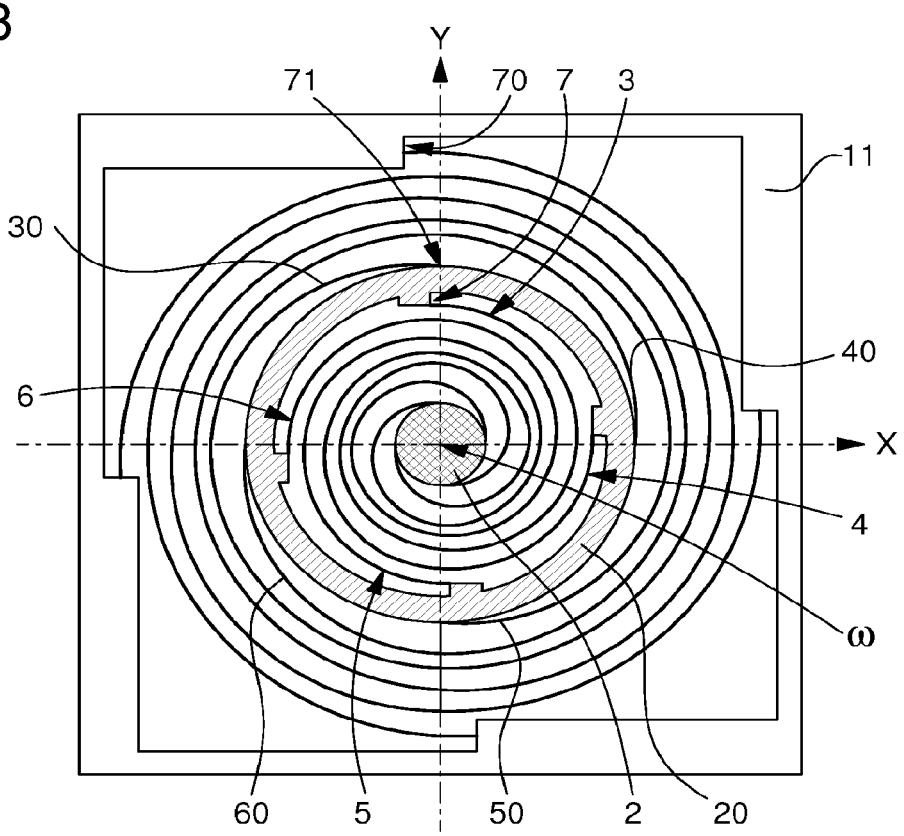
FIG. 3 illustrates, in a similar manner to FIG. 1, a variant with two concentric weights, one inside the other, and wherein, on both sides of the outermost weight the long arms are spirally wound in opposite one-directions.
Figure 4:
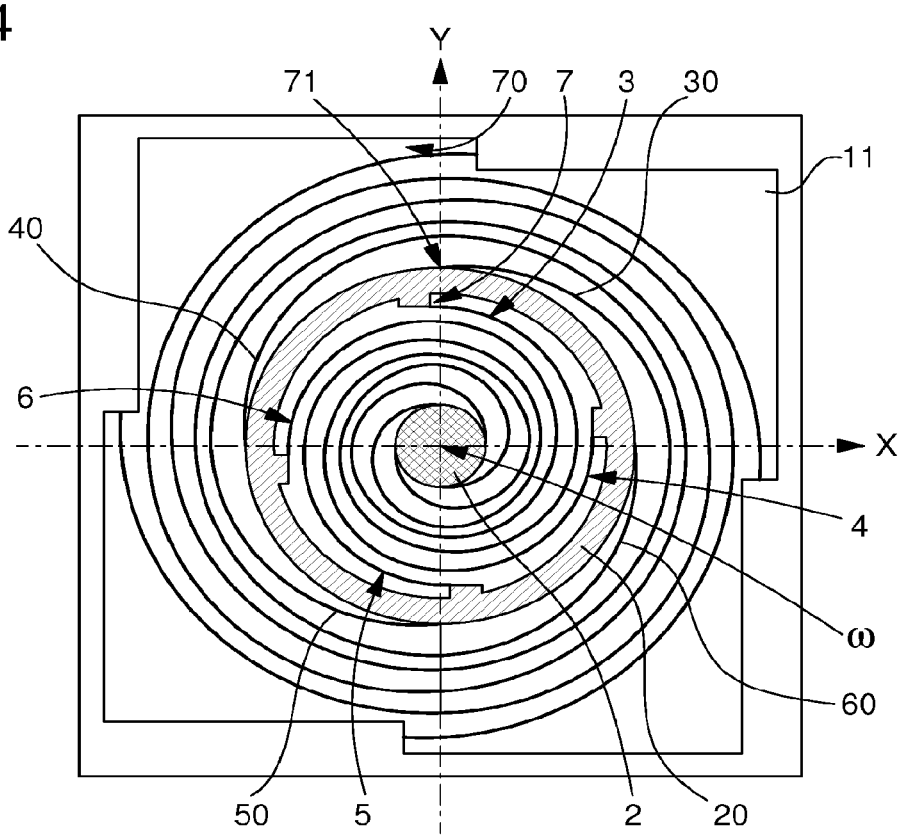
FIG. 4 illustrates, in a similar manner to FIG. 3, a variant with two concentric weights, one inside the other and wherein, on both sides of the outermost weight the long arms are spirally wound in the same one-direction.

In a specific embodiment shown in FIGS. 1, 3 and 4, each of these long arms is spirally wound around said at least one weight 2.

More specifically, resonator 1 is of the paraxial type and includes, on the one hand, first flexible strips 4, 6 arranged to maintain the oscillations of said at least one weight 2 about a virtual pivot ω in a first direction X, and on the other hand, second flexible strips 3, 7, arranged to maintain the oscillations of said at least one weight 2 about virtual pivot ω in a second direction Y orthogonal to first direction X.

In a particular preferred variant, each long arm forms a spiral of more than one turn.

In a particular variant, each long arm forms a spiral having an integer number of turns to which a half-turn is added.

In a particular variant, each long arm has a sinuous profile on either side of a radial line, derived from virtual pivot ω of weight 2, and with no return-point.

In a particular variant, each long arm has a developed length greater than the largest circumference of weight 2.

In a particular variant, first flexible strips 4, 6 are identical to each other and symmetrical with respect to virtual pivot ω in the absence of excitation of resonator 1, and the second flexible strips 3, 7 are identical to each other and symmetrical with respect to virtual pivot ω in the absence of excitation of resonator 1.

In a particular variant, first flexible strips 4, 6 and second flexible strips 3, 7 are all identical.

In a particular variant, there is an even number of first flexible strips 4, 6 and an even number of second flexible strips 3, 7.

In a particular variant, there is an equal number of first flexible strips 4, 6 and second flexible strips 3, 7.

In a particular variant, first flexible strips 4, 6 are coplanar with each other and second flexible strips 3, 7 are coplanar with each other.

In a particular variant, resonator 1 is plane, and flexible strips 4, 6 and second flexible strips 3, 7 are all coplanar with each other.

In a particular variant, the spiral pitch varies along the spiral for each of first flexible strips 4, 6 and second flexible strips 3, 7.

In a particular variant, the thickness of the spiral varies along the spiral, for each of first flexible strips 4, 6 and second flexible strips 3, 7.

In a particular variant, there is only one weight 2.

More specifically, the centre of inertia of weight 2 coincides with virtual pivot ω in the absence of excitation of resonator 1.

In a particular variant, as seen in FIG. 3, resonator 1 includes a plurality of weights 2, 20 concentric with each other about virtual pivot ω, each innermost weight being suspended from the next by first flexible strips 4, 6 and second flexible strips 3, 7, and the outermost weight being suspended from structure 11 by first flexible strips 40, 60 and second flexible strips 30, 70.

More specifically, as seen in FIG. 3, on both sides of at least one such weight 2, 20, the long arms are spirally wound in opposite one-directions.

More specifically, as seen in FIG. 3, on both sides of at least one such weight 2, 20, the long arms are spirally wound in the same one-direction.

Figure 5:
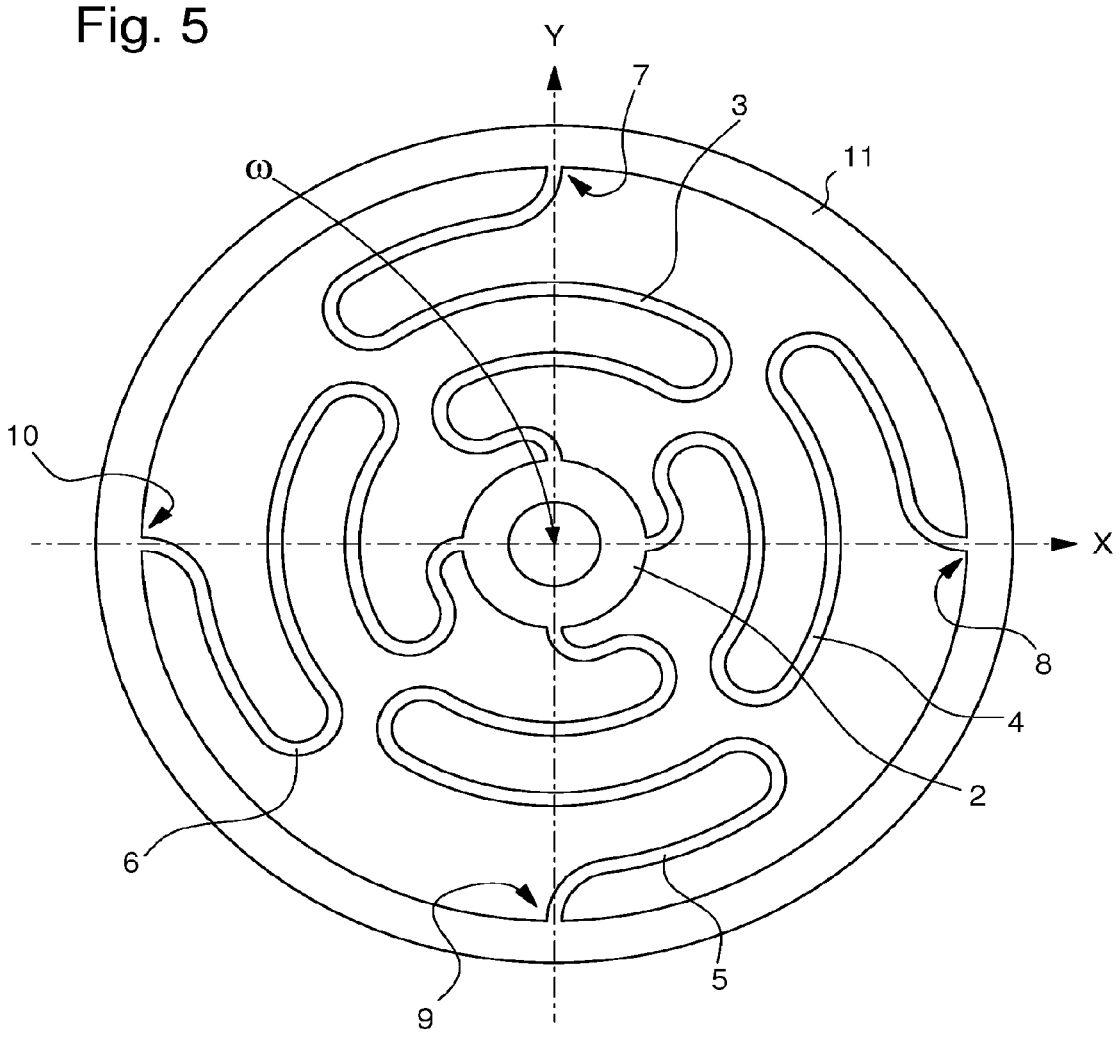
FIG. 5 shows, in a similar manner to FIG. 1, a fixed structure of a watch movement carrying a paraxial plane resonator close to the invention, including a weight suspended by four flexible strips forming long arms with a sinuous profile on both sides of a radial line, about a virtual pivot.

A particular embodiment, seen in FIG. 5, of a paraxial plane resonator 1, close to the invention, includes a weight 2 suspended by four flexible strips 3, 4, 5, 6 forming long arms each having a sinuous S-shaped profile, on both sides of a radial line, Y+, X+, Y−, X−, from a virtual pivot ω of weight 2, with no return-point.

In a particular preferred variant, resonator 1 forms a one-piece component including structure 11, weight 2 or weights 2, 20, first flexible strips 4, 6 and second flexible strips 3, 7.

In yet another variant, resonator 1 includes flexible strips arranged in superposition on several planes, notably on several parallel planes. In a specific embodiment, flexible upper strips in a first plane tend to impart a restoring torque in a first one-direction, and flexible lower strips, attached to the same weight in a second plane tend to impart a restoring torque in a second one-direction opposite to this first one-direction.

In a more highly-developed variant, resonator 1 also includes a shock-absorber device and torque limiting means, notably based on the relative support of the various arms on each other, or the different twists and turns forming the same arm, in the example of FIG. 5, on each other.

More specifically, resonator 1 is made of micromachinable material or silicon or silicon oxide or similar. An oxide layer can overcome the problem of thermal compensation.

Similarly, the resonator may be made of quartz or similar.

The invention also concerns a timepiece movement 100 including a plate that supports, directly, or indirectly by means of a fixed structure 11, at least one resonator 1 of this type.

The invention also concerns a watch 200 including a movement 100 of this type.

Resonator 1 according to the invention allows the weight 2, comprised therein, to adopt a trajectory of curvilinear translation, or, more particularly, of elliptical translation.

What is claimed is:

1. An equipped timepiece resonator for a watch movement, comprising:

one weight connected by a plurality of flexible strips to four points of attachment of a fixed structure, formed by a plate of said movement or arranged to be secured to a said plate, said weight being arranged to be subjected to a torque and/or a stress, said flexible strips including long arms spirally wound about said weight, wherein said weight is arranged to oscillate with at least two degrees of freedom in translation in a first direction, and in a second direction orthogonal to said first direction, wherein said flexible strips are arranged to maintain oscillations of said at least one weight about a virtual pivot that is movable from an initial position.

2. The equipped timepiece resonator according to claim 1, wherein each arm has a length at least two times greater than a shortest distance between said weight and said points of attachment.

3. The equipped timepiece resonator according to claim 1, wherein said resonator is paraxial with at least two degrees of freedom in translation, and wherein said flexible strips include, on the one hand, first flexible strips arranged to allow oscillations of said weight about said virtual pivot in said first direction, and on the other hand, second flexible strips arranged to allow oscillations of said weight about said virtual pivot in said second direction.

4. The equipped timepiece resonator according to claim 3, wherein said first flexible strips are identical to each other and symmetrical with respect to said virtual pivot in absence of excitation of said resonator, and wherein said second flexible strips are identical to each other and symmetrical with respect to said virtual pivot in absence of excitation of said resonator.

5. The equipped timepiece resonator according to claim 3, wherein said first flexible strips and said second flexible strips are all identical.

6. The equipped timepiece resonator according to claim 3, wherein said resonator has an even number of said first flexible strips, and an even number of said second flexible strips.

7. The equipped timepiece resonator according to claim 6, wherein said resonator has an equal number of said first flexible strips and said second flexible strips.

8. The equipped timepiece resonator according to claim 3, wherein said first flexible strips are coplanar with each other and said second flexible strips are coplanar with each other.

9. The equipped timepiece resonator according to claim 3, wherein said resonator is plane, and said first flexible strips and said second flexible strips are all coplanar with each other.

10. The equipped timepiece resonator according to claim 3, wherein each said long arm is spirally wound about said at least one weight and forms a spiral of more than one turn, and wherein a pitch of said spiral varies along said spiral for each of said first flexible strips and of said second flexible strips.

11. The equipped timepiece resonator according to claim 3, wherein each said long arm is spirally wound about said at least one weight and forms a spiral of more than one turn, and wherein a thickness of said spiral varies along said spiral, for each of said first flexible strips and of said second flexible strips.

12. The equipped timepiece resonator according to claim 2, wherein each said long arm forms a spiral of more than one turn.

13. The equipped timepiece resonator according to claim 2, wherein each said long arm forms a spiral including an integer number of turns to which a half-turn is added.

14. The equipped timepiece resonator according to claim 2, wherein said long arms each have a developed length greater than a largest circumference of said weight.

15. The equipped timepiece resonator according to claim 1, wherein there is only one said weight.

16. The equipped timepiece resonator according to claim 15, wherein a centre of inertia of said weight coincides with said virtual pivot in absence of excitation of said resonator.

17. A timepiece movement including a plate that supports, directly, or indirectly via a fixed structure, at least one equipped timepiece resonator according to claim 1.

18. The equipped timepiece resonator according to claim 1, wherein a first point and a second point of said four points are symmetrically located with respect to the initial position, and a third point and a fourth point of said four points are symmetrically located with respect to the initial position.

19. An equipped timepiece resonator for a watch movement, comprising:

one weight connected by one flexible strip or a plurality of flexible strips to one or more points of attachment of a fixed structure, formed by a plate of said movement or arranged to be secured to a said plate, said weight being arranged to be subjected to a torque and/or a stress, wherein said weight is arranged to oscillate with at least two degrees of freedom in translation, and wherein said flexible strips are arranged to maintain oscillations of said at least one weight about a virtual pivot, and wherein said resonator includes a plurality of said weights concentric with each other about said virtual pivot, each innermost weight of said weights being suspended from a next one by said first flexible strips and said second flexible strips, and an outermost one of said weights being suspended from said structure by said first flexible strips and said second flexible strips.

20. The equipped timepiece resonator according to claim 19, wherein the resonator forms a one-piece component including said structure, said weights, said first flexible strips and said second flexible strips.

21. The equipped timepiece resonator according to claim 19, wherein, on both sides of at least one said weight, long arms are spirally wound in opposite one-directions.

22. The equipped timepiece resonator according to claim 15, wherein the resonator forms a one-piece component including said structure, said weight, said first flexible strips and said second flexible strips.

23. The equipped timepiece resonator according to claim 22, wherein the resonator is made of micromachinable material or silicon or silicon oxide.

24. A watch including a timepiece movement according to claim 23.

* * * * *